US007651406B1

(12) United States Patent
Yeh

(10) Patent No.: US 7,651,406 B1
(45) Date of Patent: Jan. 26, 2010

(54) ACTIVE GOLF INSTRUCTION SYSTEM

(76) Inventor: Nai-Jen Yeh, No.8, Lane 228, Ming-Xing Rd., Zhu-Dong Town, Xin-Zhu County (TW)

( * ) Notice: Subject to any disclaimer, the term of this patent is extended or adjusted under 35 U.S.C. 154(b) by 0 days.

(21) Appl. No.: 12/330,240

(22) Filed: Dec. 8, 2008

(51) Int. Cl.
*A63B 69/36* (2006.01)

(52) U.S. Cl. ..... 473/266; 473/221; 473/271

(58) Field of Classification Search ..... 473/207–209, 473/211, 212, 215–223, 226, 257–277
See application file for complete search history.

(56) References Cited

U.S. PATENT DOCUMENTS 2,737,432 A * 3/1956 Troutman ..... 346/44
3,794,329 A * 2/1974 Wilson ..... 473/229
3,876,212 A * 4/1975 Oppenheimer ..... 473/221
4,758,000 A * 7/1988 Cox ..... 473/208
5,203,569 A * 4/1993 Rilling ..... 473/277
6,595,865 B2 * 7/2003 Stitz ..... 473/257
6,843,730 B1 * 1/2005 Bellagamba ..... 473/216

* cited by examiner

*Primary Examiner*—Nini Legesse
(74) *Attorney, Agent, or Firm*—Banger Shia

(57) ABSTRACT

An active golf instruction system comprises a first main unit and a second main unit. The first main unit further comprises three lifting mechanisms and three sliding mechanisms each connected to one lifting mechanism. A top shaft and several positioning shafts are installed in the sliding mechanisms. The second main unit further comprises a rotating wheel and a fastening unit. The first main unit and the second main unit are arranged oppositely. A student stands in between the first main unit and the second main unit. A computer control the top shaft and the positioning shafts to contact the head, shoulders, waist and knees of the student according to the height, weight, etc., of the student. A golf club is placed on the fastening unit of the second main unit. The sliding mechanisms and rotating wheel respectively rotate by appropriate degrees to provide a proper golf swing lesson.

6 Claims, 9 Drawing Sheets

ACTIVE GOLF INSTRUCTION SYSTEM

BACKGROUND OF THE INVENTION

1. Field of the Invention

The present invention relates to an active golf instruction system, particularly to an effective and easy-to-use golf instruction system.

2. Description of the Related Art

Due to higher income resulted from flourishing economy, golf is no longer a luxury sport in recent years. It is widely known that a good golfer needs sophisticated ball-striking skills. For a golf beginner, in addition to practice swings at a driving range, he may hire a coach to improve his skills faster. However, it is expensive to hire a coach. Further, a suitable coach might not always be available. Thus, it is indeed expected by golf lovers to see a mechanical device that is able to instruct golfers and enhance their skill. The current golf instruction machines usually take a passive approach to correct swing postures but not an active approach to teach students proper sequences of motions. Therefore, what could be achieved from these lessons is very limited. Based on many years experience in related fields, the inventor has been persistently devoted to researches and experiments and finally proposes the present invention to provide an improved mechanical golf instruction device and promote the learning efficiency thereof.

SUMMARY OF THE INVENTION

The primary objective of the present invention is to provide an active golf instruction system, which is easy to operate and able to give correct instructions of golf.

The active golf instruction system of the present invention comprises a first main unit, a second main unit and a computer. The first main unit further comprises three lifting mechanisms and three sliding mechanisms respectively connected to the lifting mechanisms, wherein positioning shafts are respectively installed in the sliding mechanisms and protrude outward from the first main unit. The second main unit further comprises a rotating wheel and a fastening unit installed on the rotating wheel. The first main unit and the second main unit are arranged oppositely, and a student stands in between the first main unit and the second main unit. The computer controls the positioning shafts to contact the head, shoulders, waist and knees of the student according to the height, weight, etc., of the student. A golf club is placed on the fastening unit of the second main unit. Then, the sliding mechanisms and the rotating wheel respectively rotate by appropriate degrees to provide a proper golf swing lesson.

In one embodiment of the present invention, the lifting mechanism has a mechanical device clamped by two racks. The mechanical device has a motor. A shaft of the motor meshes with two gears. The two gears mesh with the two racks. Then, forwarding or reversing rotation of the motor drives the two gears and enables the mechanical device to ascend or descend along the two racks.

In one embodiment of the present invention, the sliding mechanism is pivotally coupled to the lifting mechanism. The sliding mechanism has two box units at two ends thereof. Each box unit has a motor. Then, forwarding or reversing rotation of the motor drives the box unit to move leftward or rightward along the sliding mechanism.

In one embodiment of the present invention, each box unit has two arc-shape plates mutually crossing. Each arc-shape plate has a slot. Each of the positioning shafts penetrates the slots of two mutually-crossing arc-shape plates to obtain degrees of rotational freedom and rotate by various degrees of angles.

In one embodiment of the present invention, the rotating wheel of the second main unit is pivotally coupled to a motor and driven to rotate by the motor. The fastening unit is a clamping device made of soft material and used to clamp the head of a golf club.

DETAILED DESCRIPTION OF THE INVENTION

Figure 1:
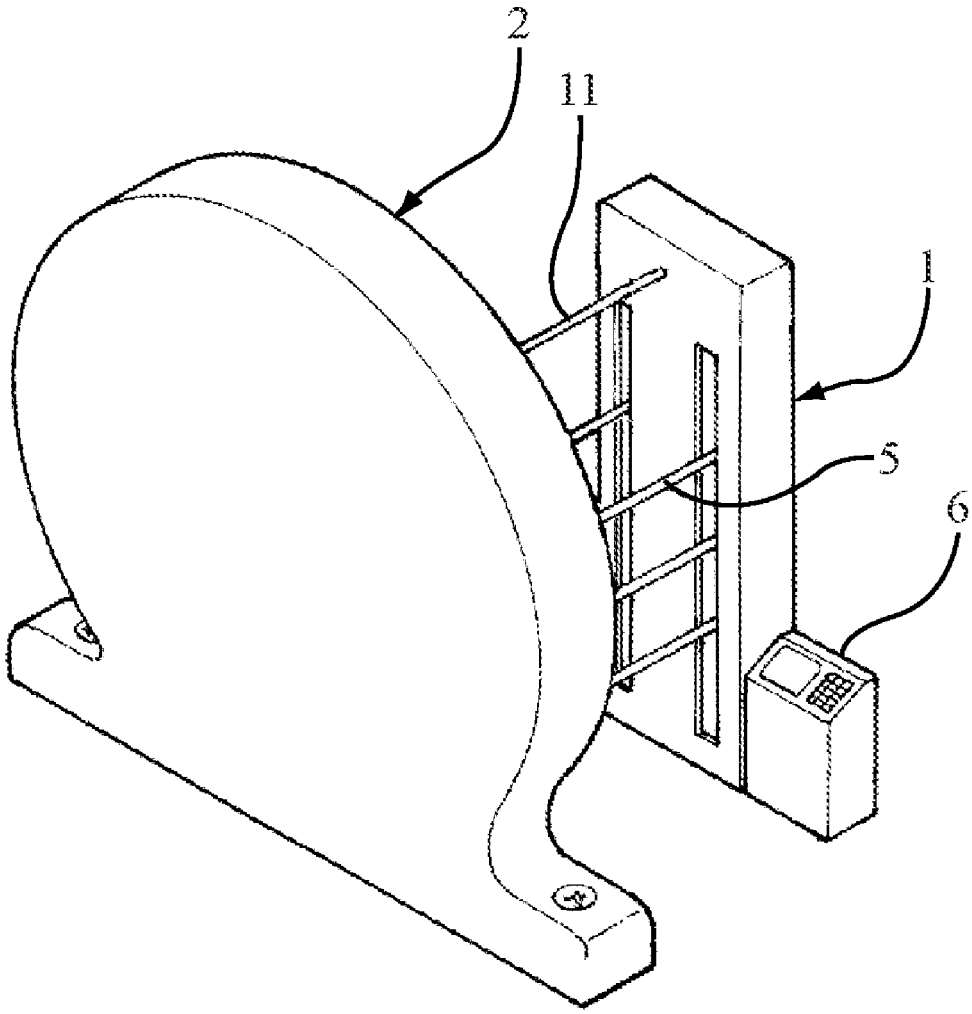
FIG. 1 is a perspective view of an active golf instruction system according to the present invention.
Figure 6:
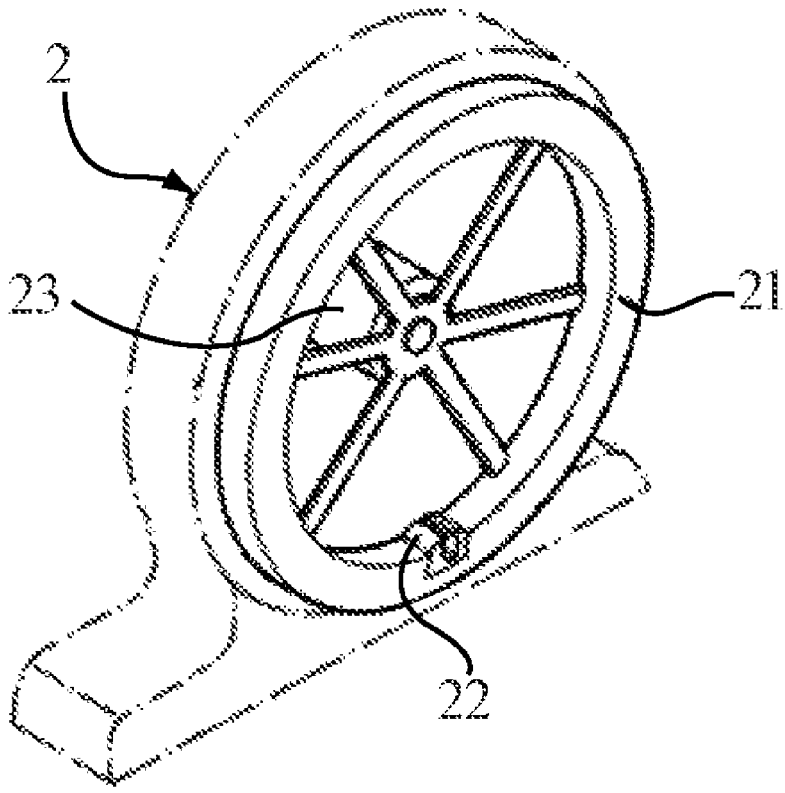
FIG. 6 is a diagram schematically showing the structure of the assembled second main unit of an active golf instruction system according to the present invention.
Figure 7:
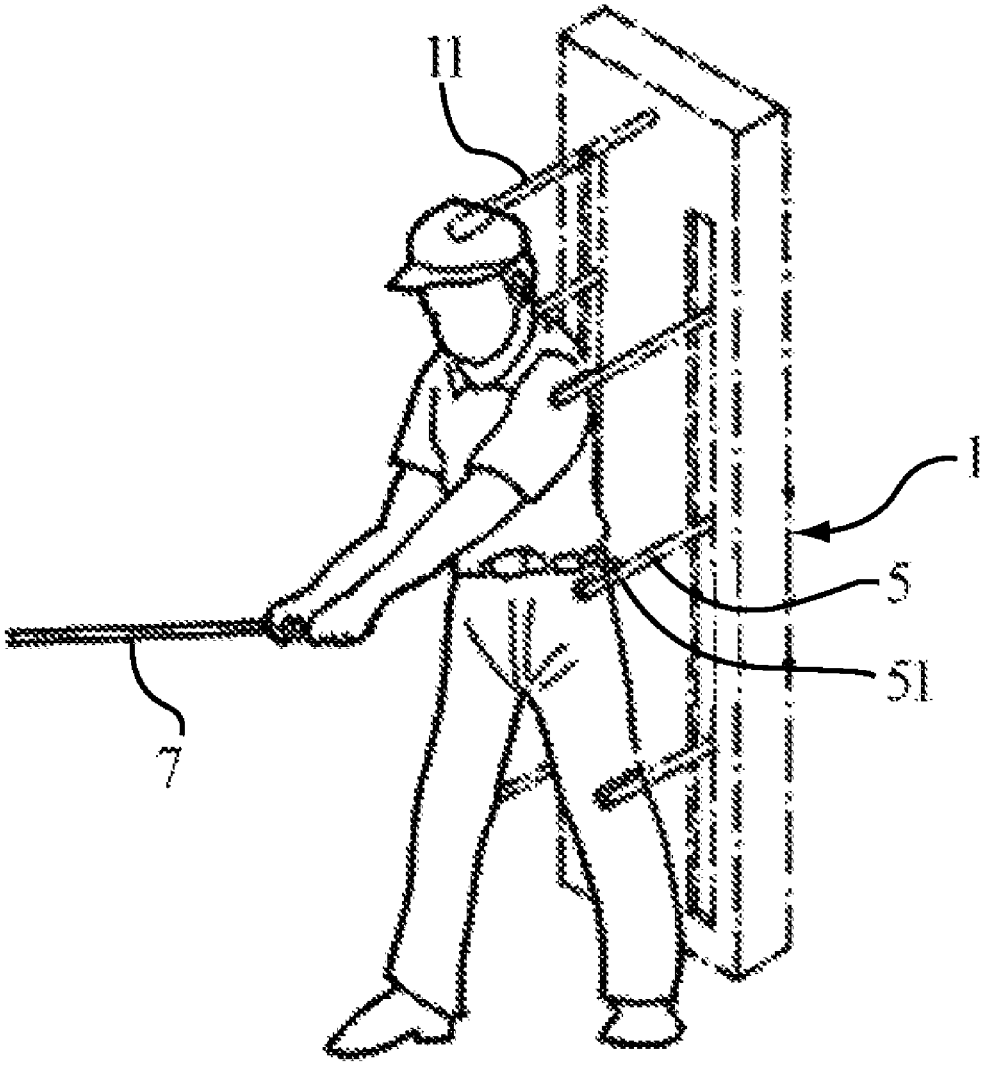
FIGS. 7-8 are diagrams schematically showing the applications of the present invention.
Figure 8:
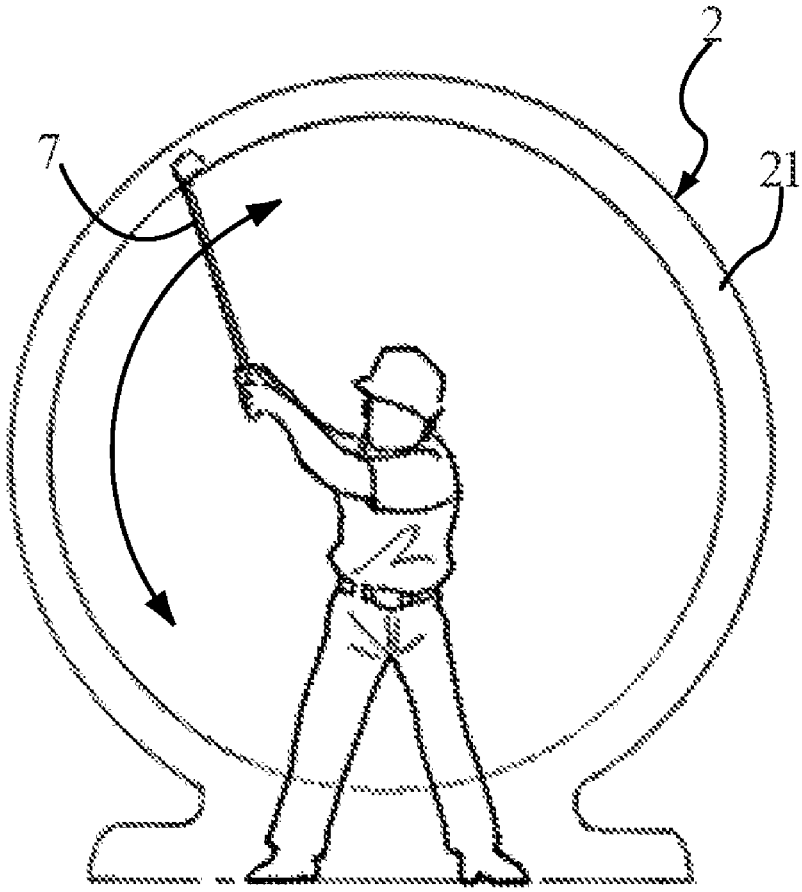

Referring to FIGS. 1 to 6. The active golf instruction system of the present invention comprises the first main unit 1 and the second main unit 2. The first main unit 1 further comprises a top shaft 11, three lifting mechanisms 3 and three sliding mechanisms 4 respectively connected to the lifting mechanisms 3, wherein positioning shafts 5 are respectively installed in the sliding mechanisms 4 and protrude outward from the first main unit 1. The second main unit 2 further comprises a rotating wheel 21, a fastening unit 22 installed on the rotating wheel 21, and a computer 6 as shown in FIG. 1 and FIG. 6.

Figure 2:
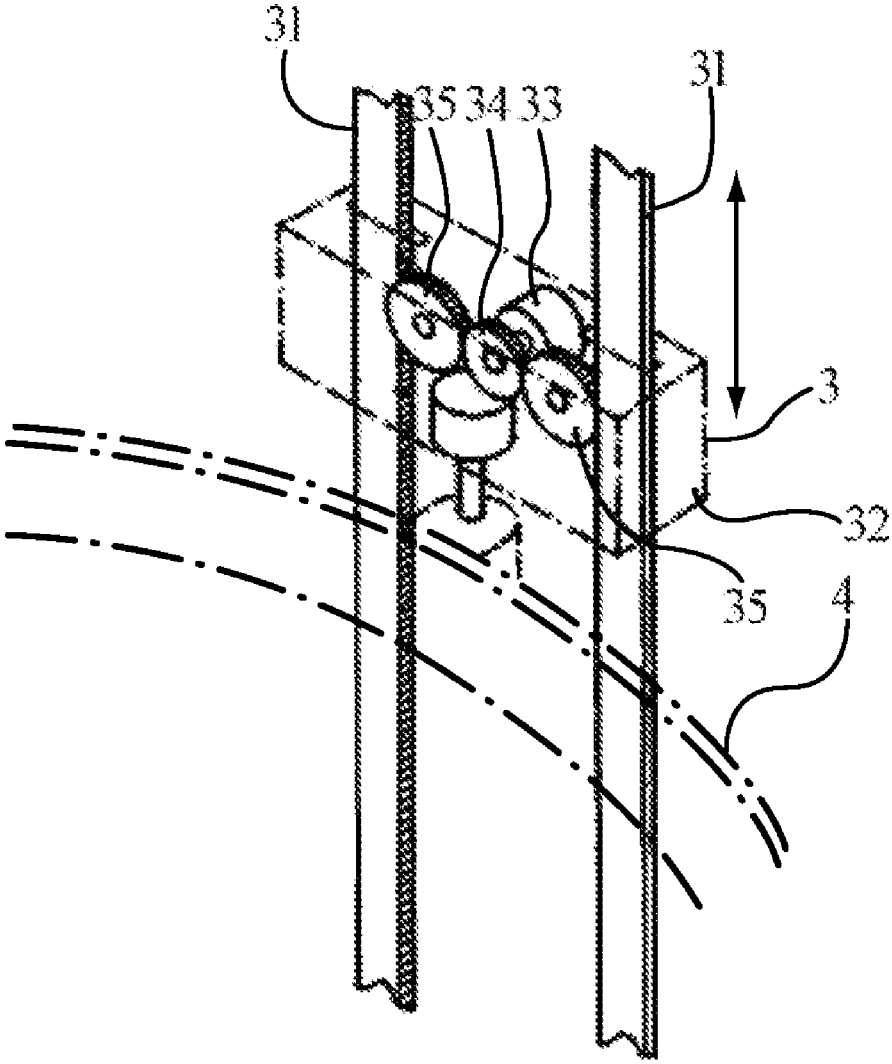
FIGS. 2-3 are perspective views of the lifting mechanism and sliding mechanism of an active golf instruction system according to the present invention.

As shown in FIG. 2, the lifting mechanism 3 has a mechanical device 32 clamped by two racks 31. The mechanical device 32 has a motor 33. A shaft 34 of the motor 33 meshes with two gears 35. The two gears 35 mesh with the two racks 31. Then, forward or reverse rotation of the motor 33 drives the two gears 35 and enables the mechanical device 32 to ascend or descend along the two racks 31.

Figure 3:
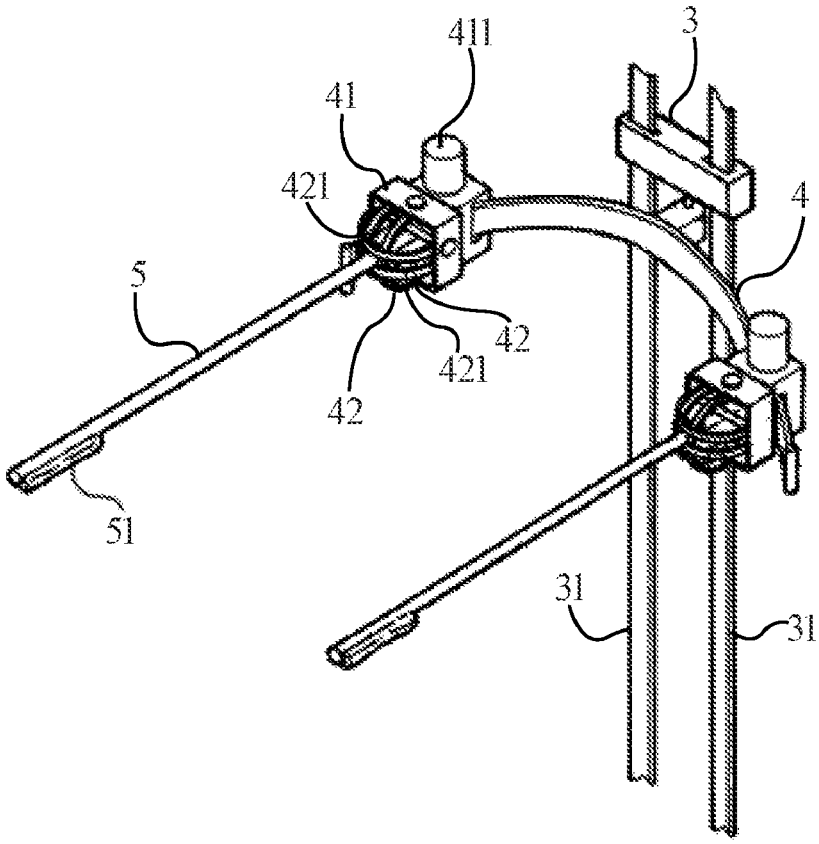
Figure 4:
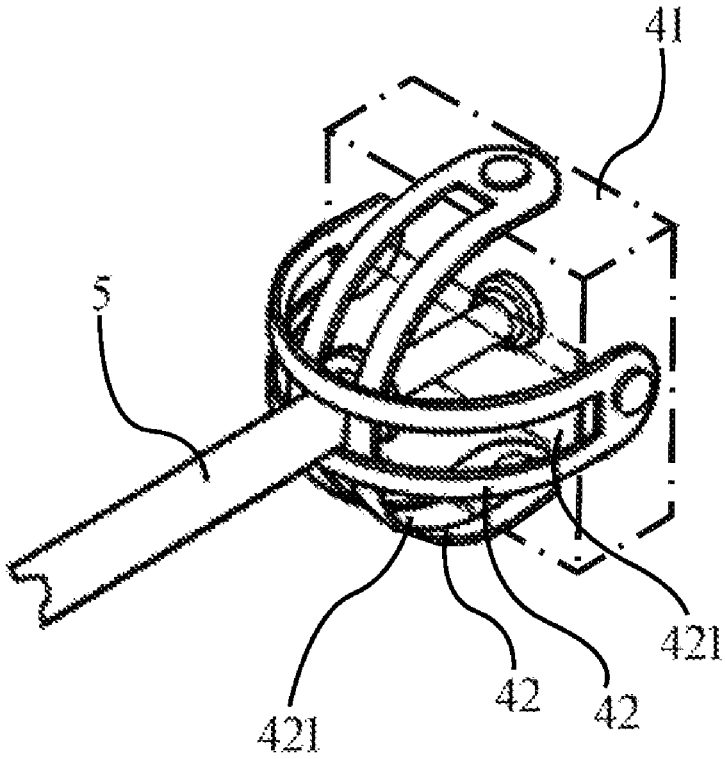
FIG. 4 is diagram schematically showing the mechanism of the positioning shaft of an active golf instruction system according to the present invention.
Figure 5:
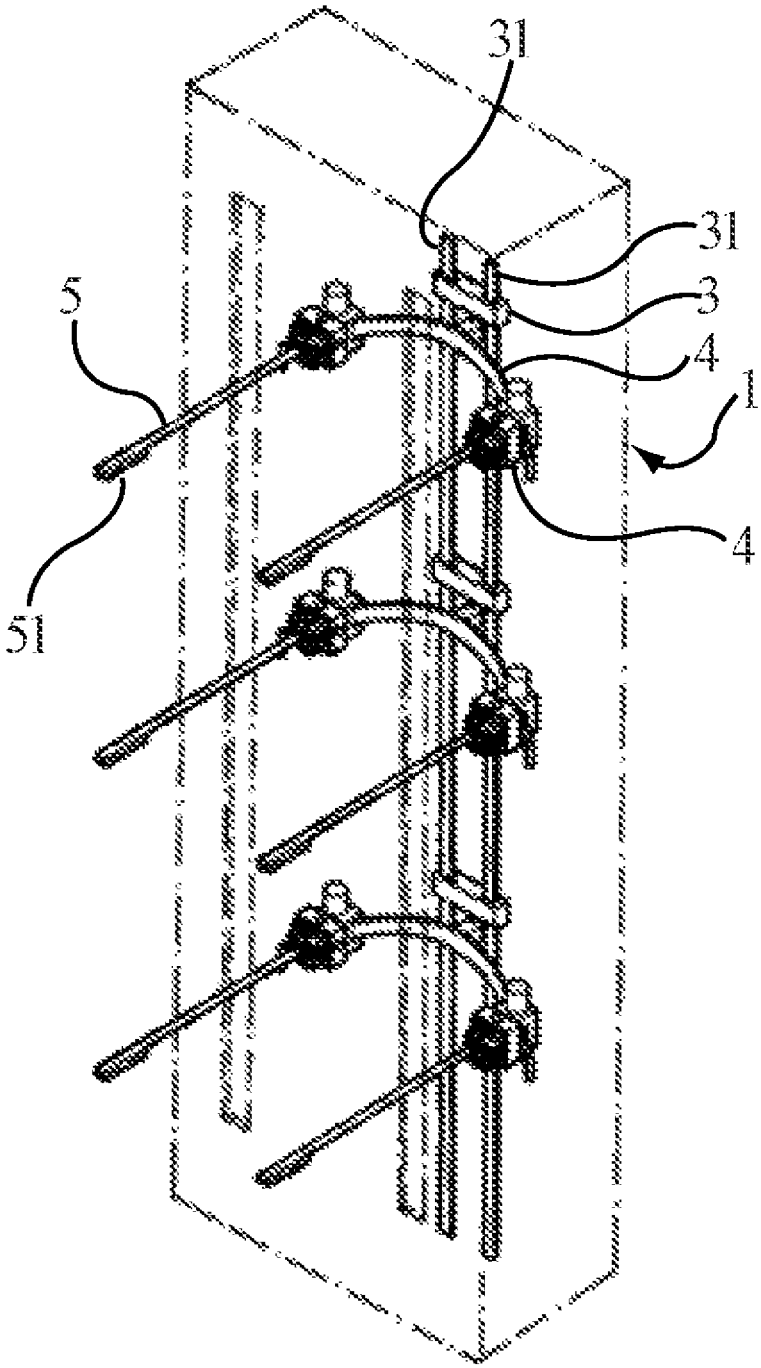
FIG. 5 is a diagram schematically showing the structure of the assembled first main unit of an active golf instruction system according to the present invention.

As shown in FIG. 3 and FIG. 4, the sliding mechanism 4 is pivotally coupled to the lifting mechanism 3. The sliding mechanism 4 is an arc-shape rod and has two box units 41 at two ends thereof. Each box unit 41 has a motor 411. Then, forward or reverse rotation of the motor 411 drives the box unit 41 to move leftward or rightward along the sliding mechanism 4. Each box unit 41 has two arc-shape plates 42 mutually crossing. Each arc-shape plate has 42 and a slot 421. Each of the positioning shafts 5 penetrates the slots 421 of two mutually-crossing arc-shape plates 42 to obtain degrees of rotational freedom and rotate by various degrees of angles.

Air bags 51 are installed on tips of the positioning shafts 5.

The rotating wheel 21 of the second main unit 2 is pivotally coupled to a motor 23 and driven to rotate by the motor 23. The fastening unit 22 is a clamping device made of soft material and used to clamp the head of a golf club.

The first main unit 1 and the second main unit 2 are arranged oppositely, and a student stands in between the first main unit 1 and the second main unit 2. The computer 6 controls the top shaft 11 and the positioning shafts 5 to contact the head, shoulders, waist and knees of the student according to the height, weight, etc., of the student. A golf club is placed on the fastening unit 22 of the second main unit 2. Then, the sliding mechanisms 4 and the rotating wheel 21 respectively rotate by appropriate degrees to provide a proper golf swing lesson.

Referring to FIGS. 5 to 8. In the application, the first main unit 1 and the second main unit 2 are arranged oppositely, and a student stands in between the first main unit 1 and the second main unit 2. First, the height, weight, etc., of the student are input into the computer 6. According to the data, the program in the computer 6 instructs the lifting mechanisms 3 of the first main unit 1 to control the altitudes of the top shaft II and the positioning shafts 5 to make the inflated air bags 51 respectively contact the head, shoulders, waist, knees, etc., of the student. A golf club 7 held by the student is placed on the fastening unit 22 of the second main unit 2. The instruction program in the computer 6 controls the box units 41 to take arc-shape displacements of appropriate degrees along the sliding mechanisms 4. The positioning shafts 5 drive shoulders, waist, knees, etc., of the student to take rotational motions. At the same time, the computer 6 instructs the motor 23 of the second main unit 2 to drive the rotating wheel 21 to rotate, and the rotating wheel 21 further takes the golf club 7 to move. Then, a proper swing instruction is thus formed by the golf club motion conducted by the second main unit 2 and the body region motions conducted by the first main unit 1.

Figure 9:
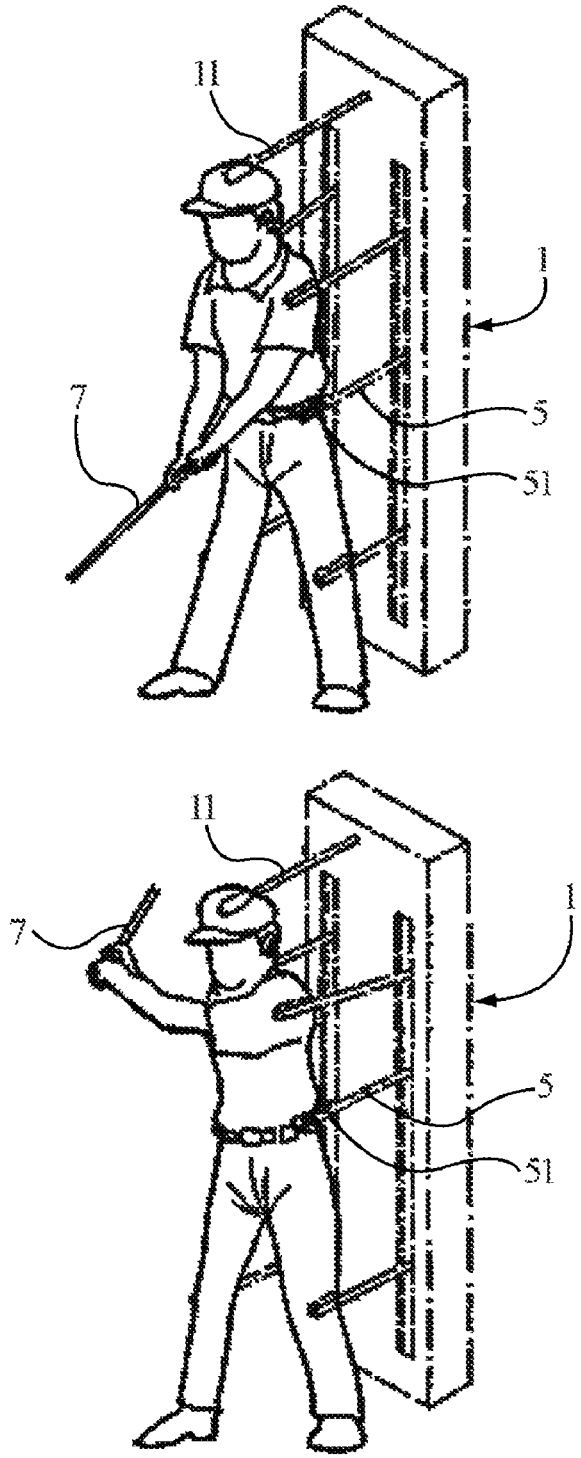
FIG. 9 is a diagram schematically showing another application of the present invention.

Referring to FIG. 9, in the application, the positioning shafts 5 of the first main unit 1 can lead the related body regions to perform a correct swing motion. The computer 6 can regulate the speeds of the positioning shafts 5 to correct the postures of the related body regions step by step. Thereby, the student will learn a correct swing motion finally.

In conclusion, the present invention proposes an active golf instruction system, which comprises a plurality of positioning shafts and a rotating wheel, and which cooperates with a computer program to undertake golf training, whereby the swing exercise becomes more convenient, and the effectiveness thereof is promoted. The present invention at least has the following advantages:

1. Best swing postures for different swing speeds have been saved in the computer;
2. After the user inputs the intended swing training, the present invention will actively take the head, shoulders, waist, knees, and wrists to exercise the related postures and motions repeatedly, whereby the muscles can memorize the correct swing postures and motions;
3. The present invention overcomes the conventional problem that the training equipments available on the market today still require users to practice swing autonomously with the speeds, angles and postures of the swing motions lacking consistency and correctness, which results in vague or incorrect muscle memory; and
4. The present invention is particularly suitable for a golf beginner because it can make the muscles of the beginner memorize the most correct postures and motions from the very beginning of learning golf.

Further, the present invention is also suitable for a profession player. When a profession player has a bias in his motions, he can use the present invention to exercise repeatedly until he restores the standard motions.

From the above description, it is known that the present invention possesses novelty and non-obviousness and meets the condition for a patent. Thus, the Inventor files the application for a patent. It will be appreciated if the patent is approved fast.

What is claimed is:

1. An active golf instruction system comprising a first main unit electrically coupled to a computer and further comprising three lifting mechanisms and three sliding mechanisms, each lifting mechanism being connected to each of said sliding mechanisms, wherein a top shaft and a plurality of positioning shafts are installed in said sliding mechanisms and protruding outward from said first main unit;

a second main unit further comprising a rotating wheel and a fastening unit installed on said rotating wheel; and a computer programmed with different standard golf swing procedures and postures, electrically coupled to said first main unit and said second main unit, and controlling said mechanisms of said first main unit and said second main unit to actively lead a student to the best swing practice, wherein said first main unit and said second main unit are arranged oppositely, and a student stands in between said first main unit and said second main unit; said computer controls said top shaft and said positioning shafts to contact the head, shoulders, waist and knees of said student according to the height, weight of said student; a golf club is placed on said fastening unit of said second main unit; said sliding mechanisms and said rotating wheel respectively rotate by appropriate degrees to provide a proper golf swing lesson.

2. The active golf instruction system according to claim 1, wherein said lifting mechanism has a mechanical device clamped by two racks; said mechanical device has a motor; a shaft of said motor meshes with two gears, and said two gears mesh with said two racks; forward or reverse rotation of said motor drives said two gears and enables said mechanical device to ascend or descend along said two racks.

3. The active golf instruction system according to claim 1, wherein said sliding mechanism is pivotally coupled to said lifting mechanism; said sliding mechanism has two box units; each box unit has a motor; forward or reverse rotation of said motor drives said box unit to move leftward or rightward along said sliding mechanism.

4. The active golf instruction system according to claim 3, wherein each said box unit has two arc-shape plates mutually crossing; each arc-shape plate has a slot; each of said positioning shafts penetrates said slots of two mutually-crossing said arc-shape plates to obtain degrees of rotational freedom and rotate by various degrees of angles.

5. The active golf instruction system according to claim 1, wherein air bags are installed on tips of said top shaft and said positioning shafts of said first main unit; after being filled with air, said air bags are respectively attached onto the head, shoulders, waist and knees of a student.

6. The active golf instruction system according to claim 1, wherein said rotating wheel of said second main unit is pivotally coupled to a motor and driven to rotate by said motor; said fastening unit is a clamping device made of soft material and used to clamp the head of a golf club.

* * * * *